US005839343A

United States Patent [19]

Michalik et al.

[11] Patent Number: 5,839,343

[45] Date of Patent: Nov. 24, 1998

[54] CUTTER BAR FOR A CUTTING CYLINDER

[75] Inventors: Horst Bernhard Michalik, Höchberg; Oswald Josef Väth, Erlenbach, both of Germany

[73] Assignee: Koenig & Bauer-Albert Aktiengesellschaft, Wurzburg, Germany

[21] Appl. No.: 858,390

[22] Filed: May 19, 1997

Related U.S. Application Data

[63] Continuation of Ser. No. 501,369, Jul. 12, 1995, abandoned.

[30] Foreign Application Priority Data

Jul. 14, 1994 [DE] Germany ..... 44 24 919.5

[51] Int. Cl.[6] ..... B26D 5/08

[52] U.S. Cl. ..... 83/663; 83/677; 83/698.61

[58] Field of Search ..... 83/698.61, 698.41, 83/663, 677

[56] References Cited

U.S. PATENT DOCUMENTS

| | | | |
|---|---|---|---|
| 565,186 | 8/1896 | Taylor | 83/677 X |
| 877,010 | 1/1908 | Spalckhaver | 83/663 |
| 1,797,448 | 3/1931 | Sheldon | 83/338 |
| 1,868,125 | 7/1932 | Tomlin | 83/674 X |
| 1,937,519 | 12/1933 | Lamatsch | 83/387 |
| 1,963,734 | 6/1934 | Crafts | 83/663 X |
| 1,985,755 | 12/1934 | Wood | 83/667 X |
| 2,038,336 | 4/1936 | Bachmann | 83/387 |
| 2,146,946 | 2/1939 | Engel | 83/663 X |
| 2,403,035 | 7/1946 | Whitson | 83/139 X |
| 2,674,026 | 4/1954 | St. Palley | 83/663 |
| 3,128,663 | 4/1964 | Dovey | 83/698.61 X |
| 3,593,606 | 7/1971 | Raybuck | 83/154 |
| 3,705,526 | 12/1972 | Bishop | 83/698.41 X |
| 4,131,047 | 12/1978 | Schriber et al. | 83/698.41 X |
| 4,640,165 | 2/1987 | McMahan et al. | 83/663 X |
| 4,784,031 | 11/1988 | Dixon | 83/346 X |
| 4,862,778 | 9/1989 | Dixon | 83/346 X |
| 4,920,843 | 5/1990 | Stromberg et al. | 83/663 X |
| 4,951,967 | 8/1990 | Michalik | 83/660 X |
| 5,259,283 | 11/1993 | Michalik | 83/659 X |

FOREIGN PATENT DOCUMENTS

| | | |
|---|---|---|
| 57-51654 | 3/1982 | Japan . |
| 656073 | 8/1951 | United Kingdom . |
| 1087327 | 10/1967 | United Kingdom . |

*Primary Examiner*—Maurina T. Rachuba
*Attorney, Agent, or Firm*—Jones, Tullar & Cooper, P.C.

[57] ABSTRACT

A cutter bar which is usable in a cutting cylinder to sever paper web trains utilizes spaced clamping strips, that contain spaced pressure strips, to sandwich a cutter blade. The pressure strips have pressure surfaces that extend out adjacent a cutter edge of the cutter blade. These pressure surfaces are compressed radially inwardly during operation of the cutting cylinder. The pressure strips are made of a small-celled, synthetic rubber material and support the cutter in a vibration-damping manner.

6 Claims, 1 Drawing Sheet

CUTTER BAR FOR A CUTTING CYLINDER

This application is a continuation of application Ser. No. 08/501,369, filed Jul. 12, 1995 now abandoned.

FIELD OF THE INVENTION

The present invention is directed generally to a cutter bar for a cutting cylinder. More particularly, the present invention is directed to a cutter bar for a cutting cylinder in a folding unit. Most specifically, the present invention is directed to a cutter bar for a cutting cylinder in a folding unit of a web-fed rotary printing press. A cutter blade having a cutter edge is sandwiched between pressure strips which are, in turn, held between clamping rails or channels. The cutter blade accomplishes the transverse cutting of a paper web by cooperation with a separate folding and collecting cylinder having spaced point needles that grip the cut sheet. These point needles may penetrate into the resilient pressure strips of the cutter bar.

DESCRIPTION OF THE PRIOR ART

The cutting of a continuously advancing printed paper web in a web-fed rotary printing press is typically accomplished by the utilization of a cutting cylinder that cooperates with a folding and collecting cylinder. One such cutting device in a folding apparatus of a web-fed printing press is shown in U.S. Pat. No. 1,868,125. In this prior art patent, a cutting cylinder cooperates with a folding and collecting cylinder which has a groove on its peripheral surface and which is provided with a cutting strip that is received in this groove. The collecting cylinder is also provided with point needles that engage and grip the leading edges of a signature that is cut from the paper web.

The cutting strip which is located in the collecting cylinder extends parallel to the axis of rotation of the collecting cylinder and is located in the groove in the collecting cylinder such that the face of a cutter bar which is cooperating with a cutter is located on the level of the jacket surface of the collecting cylinder. A plurality of point needles are disposed on the collecting cylinder parallel to the cutting strip and with their points projecting past the jacket surface of the collecting cylinder and into the cutting cylinder. The point needles have free, pointed ends that penetrate into the cutting cylinder. These free ends make a movement relative to the cutting cylinder in the circumferential direction of this cylinder. In order to allow the point needles to perform this circumferential movement, it is necessary that the cutting cylinder, or the pressure strip of the cutting cylinder be recessed in the movement areas of the point needles.

In this prior art device, the cutting cylinder also has a groove which extends across the surface of the cylinder in the direction of rotation of the cylinder. A cutter holder is disposed in this groove. The cutter holder receives and holds a cutter blade. Radially movable pressure strips are arranged to rest against the cutter and against the lateral walls of the cutter holder.

In this prior art device, there is no surface for the point needle in the collecting cylinder to act against. These point needles are received in the recesses in the cutting cylinder or in the pressure strips in the cutting cylinder. This results in damage being done to the signatures in the areas of the signatures being penetrated by the point needles. The highly stressed areas of the signatures, which are the areas being penetrated by the unsupported point needles, are apt to be damaged by bursting.

Another prior art device is shown in U.S. Pat. No. 1,985,755 which also discloses a cutting device in a folding apparatus in which a cutting cylinder cooperates with a collecting cylinder. In this device, the collecting cylinder is provided with a cutter strip and with point needles. A cutter in the cutting cylinder is supported by pressure strips which extend parallel to the cutter. These pressure strips are provided with recesses into which the point needles enter. These recesses in the pressure strips are filled with a resilient material.

In this prior art device, as well as in the previously discussed prior art device, there is only a short clamping length for the cutter. This is because of the structure of the pressure strips resting against the cutter and the lateral walls of the cutter holder. The cutter is subjected to large bending stresses during its cooperation with the collecting cylinder. This is because the cutter also moves in the circumferential direction relative to the cutter bar in the cutting cylinder as it cooperates with the cutter strip in the collecting cylinder.

It will be apparent that a need exists for a cutter bar which overcomes the limitations of the prior art devices. The cutter bar for a cutting cylinder in accordance with the present invention provides such a device and is a significant improvement over the prior art devices.

SUMMARY OF THE INVENTION

It is an object of the present invention to provide a cutter bar for a cutting cylinder.

Another object of the present invention is to provide a cutter bar for a cutting cylinder in a folding apparatus.

A further object of the present invention is to provide a cutter bar for a cutting cylinder in a folding apparatus of a rotary printing press.

Still another object of the present invention is to provide a cutter bar which is supported between pressure strips.

Yet a further object of the present invention is to provide a cutter bar in which the cutter blade is supported, so as to be dampened against vibrations, in the circumferential direction of the cutting cylinder.

Even yet another object of the present invention is to provide a cutter bar in which signature cuts or tears caused by the point needles are prevented.

As will be discussed in greater detail in the description of the preferred embodiment, which is presented subsequently, the cutter bar of a cutting cylinder in a folding unit of a web-fed rotary printing press is provided with a cutter blade that extends parallel to the axis of rotation of the cutting cylinder. The cutter blade is fastened in the cutter bar by being sandwiched between pressure strips which are, in turn, held between clamping rails. The pressure strips are a resilient material, such as a synthetic rubber and have a small-celled structure. The cutting cylinder cooperates with a collecting cylinder that has point needles with point ends. These point needles penetrate into penetration points in the pressure strips. The synthetic rubber used to form the pressure strips has a suitable elastic modulus and hardness together with an appropriate height and shape which allows it to function properly.

The cutter bar in accordance with the present invention is provided with penetration points in the synthetic rubber of the pressure strips instead of the recesses provided in the prior art devices. These resilient pressure strips allow the point needles to enter or pass through the signatures without bursting or otherwise damaging the edges of the signatures. This is because the pressure strips act as flat surfaces which support the signatures opposite to the point needles. It is this support of the signature edges by the pressure strips that prevents bursting or other damaging of the signature edges to occur when these edges are penetrated by the needle points.

Relative movement of the point needles in the circumferential direction with respect to the pressure strips is made possible by the resiliency of the pressure strips, even though these pressure strips are not provided with recesses, as were the prior art devices. It is particularly advantageous that the resilient material used in the pressure strips is a small-celled resilient material. Tearing of the cells of this small-celled resilient material by the needle points is prevented, in spite of the relative movement of the point needles.

The use of the small-celled synthetic rubber for the pressure strips affords a high degree of mechanical wear resistance, such as abrasion resistance, and thus a long service life of the pressure strips. A desired degree of flexibility over a wide temperature range is also provided by the use of a synthetic rubber, small-celled material for the pressure strips.

The pressure strips are compressed radially inwardly in a spring path when the cutter blade engages the cutting strips on the collecting cylinder. The large height of the pressure strip in comparison to its spring path minimizes heat generation during web cutting due to the elastic-viscous properties of the polymers. This ratio of height to spring path also makes possible a longer than average service life for the cutter bar in accordance with the present invention.

The cutter blade is clamped between the clamping rails of the cutter bar along its base area. This creates a comparatively large cantilever length of the cutter blade. This large cantilever length means that the bending stresses being generated in the blade, as the blade's cutting edge move circumferentially during cutting, at the clamping position of the blade during the process are minimized. These bending stresses are caused when the cutting edge of the cutter has a greater circumferential speed than the collecting cylinder. The minimization of these bending stresses result in an increase in the service life of the cutter blade.

Any vibrations in the cutter blade, due to spring back of the cutter blade occurring after the cutting process, are minimized because of the resilient nature of the pressure strips. The excellent damping properties of the pressure strips also results in noise reduction during the operation of the folding apparatus.

It will be seen that the cutter bar for a cutting cylinder in accordance with the present invention, overcomes the limitations of the prior art devices. It is a substantial advance in the art.

BRIEF DESCRIPTION OF THE DRAWINGS

While the novel features of the cutter bar for a cutting cylinder in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

The point needles fix the signatures in place on the surface of the folding and collecting cylinder. The cutting cylinder has a groove on its peripheral surface, with this groove extending parallel to the axis of rotation of the cutting cylinder. This discussion is for the purpose of establishment of the environment in which the cutter bar in accordance with the present invention find use. This environment is not specifically depicted in the accompanying drawings since such an environment is generally conventional in the art.

Figure 1:
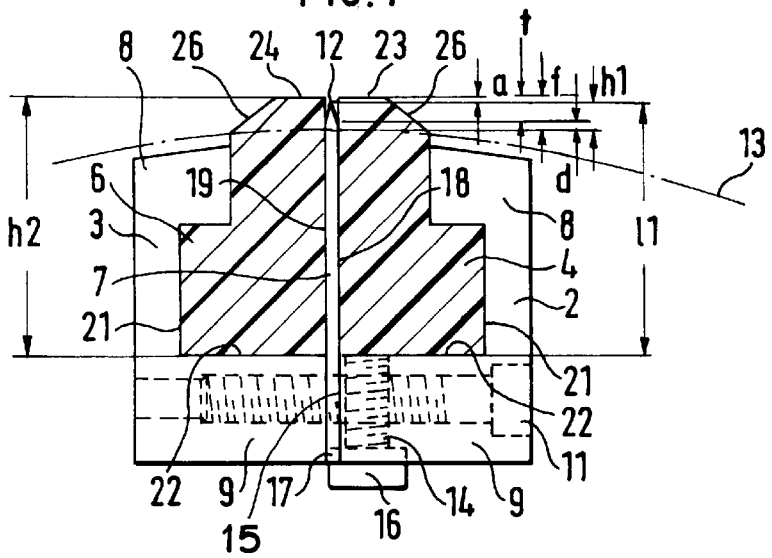
FIG. 1 is a cross-sectional view of a cutter bar for a cutting cylinder in accordance with the present invention.
Figure 2:
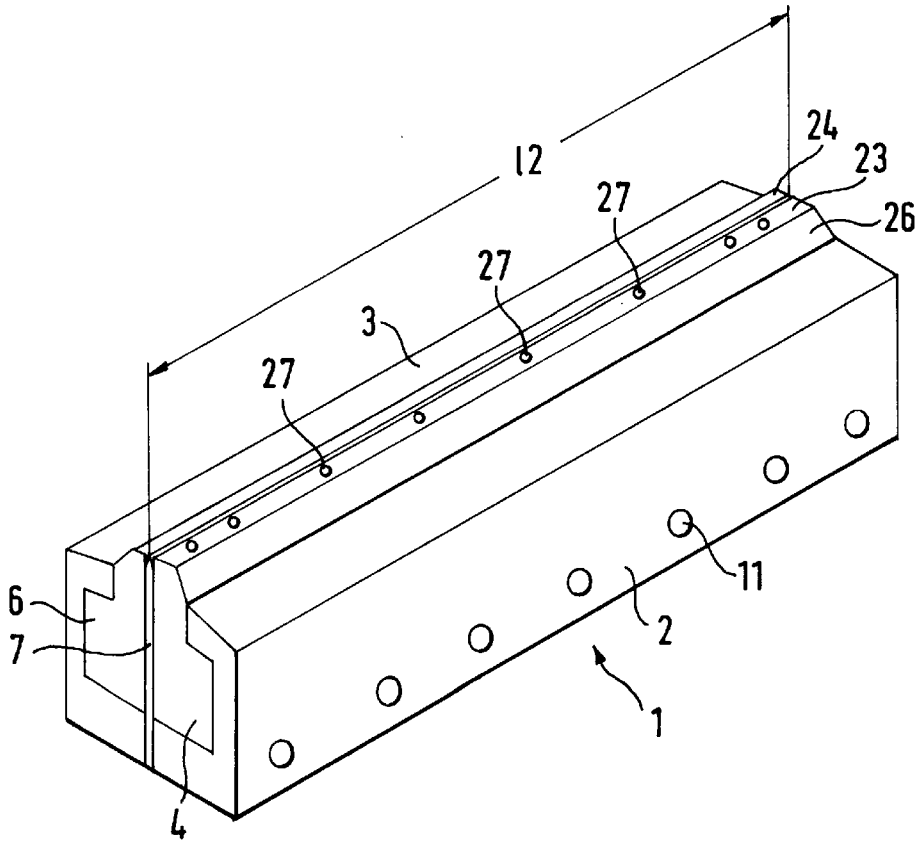
FIG. 2 is a perspective view of the cutter bar of the present invention.

Referring now to FIGS. 1 and 2 there may be seen, generally at 1, a cutter bar in accordance with the present invention. Cutter bar 1 is positionable in the groove in a cutting cylinder, which is not shown, and is usable in conjunction with a folding and collecting cylinder that is also not specifically shown in the drawings. The cutter bar, generally at 1, is formed by right and left or first and second clamping strips or rails 2 and 3, which encompass right and left or first and second pressure strips 4 and 6 that, in turn sandwich a cutter blade 7 which, as seen in FIGS. 1 and 2, is an elongated, generally flat blade. As seen in FIG. 1, the two clamping strips or rails 2 and 3 are generally U- or channel shaped in cross-section and each has an upper leg 8, and a lower leg 9 which are connected by a central web. The upper leg 8 of each of the clamping strips or rails 2 and 3 is structured to be shorter than its associated lower leg 9. The cutter blade 7 has a lower portion 15 which is clamped between the lower legs 9 of the two clamping strips 2 and 3 and which is generally perpendicular to these two lower legs 9. Suitable screws 11 are situated in aligned threaded bores in the lower legs 9 of the clamping rails 2 and 3 and pass through cooperatively placed openings (not shown) in the lower portion 15 of the cutter blade 7. A large bending or cantilever length l1 of the cutter blade 7, which is typically 25 to 50 mm, results from the clamping of only the lower portion 15 of the cutter blade 7 between the two lower legs 9 of the clamping strips 2 and 3.

The cutting cylinder has a theoretical roll-off jacket area which is denoted by the dot-dash line 13 in FIG. 1. This is the position of the jacket surface of the cutting cylinder which carries the cutter bar 1. The cutter blade 7 has an upper cutter edge 12 which as seen in FIG. 1, projects beyond this roll-off jacket area 13 by a projection height h1. This projection height h1 is the sum of a thickness "d" (approximately 2 to 4 mm) of the train of several paper webs, as depicted in FIG. 1, plus the penetration depth "t" (approximately 3 to 5 mm) of the cutter edge 12 of the cutter blade 7 into the cutting strip of this folding and cutting cylinder which is not specifically shown in the drawings.

A height adjustment of the cutter blade 7 with respect to the clamping strips 2 and 3 can be accomplished by use of stop screws 14. As is seen in FIG. 1, these stop screws 14 are screwed into the lower leg 9 of the right clamping strip 2 and extend generally parallel to the cutter blade 7. Each stop screw 14 has an enlarged screw head 16 that supports a lower end 17 of the cutter blade 7. These screw heads 16 thus act as stops for the cutter blade 7. They fix the position of the cutter blade 7 with respect to the cutter bar 1. This accordingly fixes the height h1 of the cutter blade 7 above the theoretical roll-off jacket surface 13 of the cutting cylinder. Adjustment of the height of the cutter blade 7 may be accomplished by slight separation of the two clamping rails 2 and 3 by use of clamping screws 11 and by rotation of the stop screws 14 to move the cutter blade 7 vertically.

The first and second pressure strips 4 and 6 are positioned in the cutter bar 1, generally in the central cavities of the first and second U-shaped or channel shaped clamping strips or rails 2 and 3. These first and second pressure strips 4 and 6 extend parallel to first and second side surfaces 18 and 19 of the cutter blade 7 and have inner sides that rest flat against these side surfaces. In a similar manner, outer sides of the first and second pressure strips 4 and 6 rest against inner side and base surfaces 21 and 22, respectively of each of the first and second U-shaped or channel shaped clamping strips 2 and 3.

Referring again primarily to FIG. 1, each of the first and second pressure strips 4 and 6 has an overall height h2 and each has an upper pressure surface 23 or 24 which extends in a radial direction beyond the cutter edge 12 of the cutter blade 7 by a projection distance "a". The first and second upper pressure surfaces 23 and 24 of the pressure strips 4 and 6 press the train of several paper webs against the cutting strip on the cutting cylinder with which the cutter bar 1 cooperates. Each of the upper pressure surfaces 23 and 24 of the first and second pressure strips 4 and 6 extend along the entire length l2 of the cutter blade 7, as may be seen in FIG. 2. These upper pressure surfaces 23 and 24 can each be provided with a beveled shoulder 26 which shoulders 26 are circumferentially spaced from each other and which each taper radially outwardly. The pressure strips 4 and 6 can also be provided with other profile cross-sections. However, all of these profile cross-sections will have in common the feature that the pressure strips 4 and 6 will supportingly engage at least three surfaces or sides. Thus each pressure strip 4 or 6 will have a first pressure strip side which engages a flat side surface 18 or 19 of the cutter blade 7; a second pressure strip side which is opposite to the first and which engages the inner side surface 21 of the central web of the clamping strip 2 or 4; and a third pressure strip side or surface which absorbs the pressure forces and which extends generally parallel to the paper web train. In this instance, this third pressure strip side contacts the inner base surface 22 of the lower leg 9 of each of the clamping strips or rails 2 and 4. It would be possible in accordance with the present invention for each pressure strip 4 and 6 to be made in several longitudinal sections that extend along the length l2 of the cutter blade 7.

Each of the pressure strips 4 and 6 is, in accordance with the present invention, made of a synthetic material and has a spring path "f". This is the distance that the pressure strips 4 and 6 compress radially inwardly during cutting of the paper web train by the cutter blades 7. As may be seen in FIG. 1, the spring path "f" is the sum of the projection distance "a" of the pressure strips 4 and 6 radially beyond the cutter edge 12, plus the thickness "d" of the paper web train, and the penetration depth "t" of the cutter edge 12 of the cutter blade 7 into the cooperating cutter strip on the folding and collecting cylinder. The pressure strip height h2 is between 8 and 15 times the distance of the spring path "f". Thus the ratio range of "f" to h2 is between 1 to 8 and 1 to 15.

Each of the pressure strips 4 and 6 is made of a resilient material, such as a small-celled synthetic caoutchouc or rubber. The elastic modules of the material is between approximately $50N/mm^2$ to $1000N/mm^2$. The hardness of the resilient material used in the pressure strips 4 and 6 is approximately 10 to 30 Shore A. A polyurethane elastomer with an open-celled structure is particularly suited as the synthetic rubber because of its excellent mechanical wear and good damping properties.

Turning again to FIG. 2, the upper pressure surfaces 23 and 24 of the pressure strips 4 and 6 have penetration points 27 into which the point needles of the folding and collecting cylinder penetrate. These point needles perform a relative movement in the circumferential direction during the cutting process, in which the pressure strips 4 and 6 move radially inwardly, as discussed above. The upper pressure surfaces 23 and 24 of the pressure strips 4 and 6 are not recessed at these penetration points 27 but instead are designed entirely flat.

As was discussed briefly previously, as the cutter blade 7 cooperates with the cutting strip on the folding and collecting cylinder to sever the paper web train, it undergoes a movement relative to the cutting cylinder in the circumferential direction of the cutting cylinder. In other words, the cutter edge 12 moves either to the right or to the left with respect to its clamped lower portion 15 during cutting of the paper web train. Because of this, bending stresses act on the cutter blades 7. The resilient pressure strips 4 and 6 are also deformed in the circumferential direction during the cutting process. The cutter blades 7 springs back to its original vertical initial position at the end of each cutting process. This is apt to create an oscillating movement in the cutter blade 7. Such an oscillating movement is strongly dampened by the action of the pressure strips 4 and 6 resting against the cutter.

While a preferred embodiment of a cutter bar for a cutting cylinder in accordance with the present invention has been set forth fully and completely hereinabove, it will be apparent to one of skill in the art that a number of changes in, for example, the overall size of the cutter bar, the length of the cutter bar, the type of cutter blade used and the like can be made without departing from the true spirit and scope of the present invention which is accordingly to be limited only by the following claims.

What is claimed is:

1. A cutter bar for a cutting cylinder of a folding unit of a web-fed rotary printing press to sever a paper web train into signatures, said cutter bar comprising:

an elongated, generally flat cutter blade having a cutter edge, a cutter blade lower portion, a lower end, and cutter blade side surfaces;

first and second clamping rails, each of said first and second clamping rails having an upper leg, a lower leg, and a central web, said central web of each of said first and second clamping rails connecting said upper leg and said lower leg and defining therewith a central cavity having an inner surface, said lower leg of each of said first and second clamping rails engaging said lower portion of said cutter blade and supporting said cutter blade; and first and second pressure strips interposed in said central cavities of said first and second clamping rails between said first and second clamping rails and said cutter blade and engaging said side surfaces of said cutter blade and said inner surfaces of said central cavities of said first and second clamping rails, each of said first and second pressure strips consisting of a small-celled synthetic rubber having an elastic modulus of $50N/mm^2$ to $1000N/mm_2$ and a hardness of 10 to 30 Shore A, each of said first and second pressure strips further having a height and a spring path, said spring path being a distance each said first and second pressure strips is compressed by engagement with a paper web during a cutting operation of said cutter bar, said spring path distance of each of said pressure strips having a ratio to said height of each of said pressure strips of between 1 to 8 and 1 to 15, each of said first and second pressure strips further having an upper pressure surface, each said upper pressure surface extending upwardly beyond said upper leg of each said first and second clamping strip and said cutter edge of said cutter blade.

2. The cutter bar in accordance with claim 1 wherein each of said first and second pressure strips is a polyurethane elastomer with an open-celled structure.

3. A cutter bar comprising:

a cutter blade having a cutter edge, first and second cutter blade side surfaces, a cutter blade lower portion, and a cutter blade lower end;

first and second clamping rails, each of said first and second clamping rails having an upper leg, a lower leg, and a central web, said central web of each of said first and second clamping rails connecting said upper leg and said lower leg and defining a central cavity having an inner surface, said cutter blade lower portion being secured between said lower leg of said first clamping rail and said lower leg of said second clamping rail; and first and second pressure strips positioned in said central cavities of said first and second clamping rails and intermediate said first and second cutter blade side surfaces and said inner surface of each of said first and second clamping rails, each of said first and second pressure strips having an upper pressure surface adjacent said cutter edge, said upper pressure surface of each of said first and second pressure strips being positioned above said upper leg of each of said first and second clamping rails, each of said first and second pressure strips having a height above said lower leg of each of said first and second clamping rails and further wherein each of said first and second pressure strips has a spring path, said height being 8 to 15 times greater than said spring path.

4. A cutter bar comprising:

a cutter blade having a cutter edge, first and second cutter blade side surfaces, a cutter blade lower portion, and a cutter blade lower end;

first and second clamping rails, each of said first and second clamping rails having an upper leg, a lower leg, and a central web, said central web of each of said first and second clamping rails connecting said upper leg and said lower leg and defining a central cavity having an inner surface, said cutter blade lower portion being secured between said lower leg of said first clamping rail and said lower leg of said second clamping rail; and first and second pressure strips positioned in said central cavities of said first and second clamping rails and intermediate said first and second cutter blade side surfaces and said inner surface of each of said first and second clamping rails, each of said first and second pressure strips being a synthetic elastomer having a small-celled structure with an elastic modulus of 50N/$mm^2$ and each having an upper pressure surface adjacent said cutter edge, said upper pressure surface of each of said first and second pressure strips being positioned above said upper leg of each of said first and second clamping rails.

5. The cutter bar of claim 4 further wherein each of said first and second pressure strips has a hardness of 10 to 30 Shore A.

6. The cutter bar of claim 5 wherein each of said first & second pressure strips is a polyurethane with an open-celled structure.

* * * * *